US005108006A

United States Patent [19]

Tieke et al.

[11] Patent Number: 5,108,006

[45] Date of Patent: Apr. 28, 1992

[54] TABLET DISPENSER WITH LOCKING MEANS

[75] Inventors: Edward S. Tieke, Trumbull; Robert E. Dawson; Douglas W. Smith, both of Ridgefield; John S. Gruver, Huntington, all of Conn.

[73] Assignee: The Procter & Gamble Company, Cincinnati, Ohio

[21] Appl. No.: 515,978

[22] Filed: Apr. 27, 1990

[51] Int. Cl.[5] ..... B65G 59/00

[52] U.S. Cl. ..... 221/152; 221/154; 221/3; 221/4; 221/266

[58] Field of Search ..... 221/152, 151, 154, 266, 221/263, 3, 4; 222/153, 361, 362, 363, 366, 510; 206/536, 540, 807

[56] References Cited

U.S. PATENT DOCUMENTS

| | | | |
|---|---|---|---|
| 1,801,634 | 4/1931 | Moore . | |
| 2,117,685 | 5/1938 | Smith, Jr. | 312/89 |
| 2,219,422 | 10/1940 | Jordan | 206/42 |
| 2,886,208 | 5/1959 | Sinclair | 221/288 |
| 3,130,862 | 4/1964 | Lachance | 221/154 |
| 3,289,885 | 12/1966 | Villaveces | 221/288 |
| 3,866,796 | 2/1975 | Bozek | 221/152 |
| 3,921,851 | 11/1975 | Nilson | 221/151 |
| 3,968,902 | 7/1976 | Bachmann | 221/263 |
| 4,117,956 | 10/1978 | von Schuckmann | 221/288 |
| 4,230,236 | 10/1980 | Boulter | 221/190 |
| 4,418,838 | 12/1983 | Gallina | 221/246 |
| 4,428,502 | 1/1984 | Veltri | 221/152 |
| 4,564,124 | 1/1986 | Burton | 221/263 |
| 4,564,125 | 1/1986 | Esslinger | 221/288 |
| 4,724,984 | 2/1988 | Wilken et al. | 221/266 X |
| 4,767,023 | 8/1988 | Hackmann et al. | 221/152 |

FOREIGN PATENT DOCUMENTS 0345413 12/1989 European Pat. Off. .

*Primary Examiner*—David H. Bollinger

*Attorney, Agent, or Firm*—Michael E. Hilton; E. Kelly Linman; Richard C. Witte

[57] ABSTRACT

A tablet dispensing container comprehending a tubular sleeve, a reciprocating element and a locking mechanism. The tubular sleeve forms the container and has two opposing openings therein; a dispensing opening in the lower end and a reciprocating element opening in the upper end. The reciprocating element is attached to the tubular sleeve and is biased toward the upper end. A user manually depresses the reciprocating element which forces the end with the tablet accommodating mechanism through the dispensing opening thereby dispensing a tablet. A locking mechanism prevents the reciprocating element from reciprocating when in a locked position. The locking mechanism permits reciprocation of the reciprocating element when in the unlocked position. The locking mechanism is adapted to remain in either the locked or the unlocked position until manually moved to the other position. Preferably, the locking mechanism includes a visual signal which indicates when the locking mechanism is in the unlocked position. Even more preferably, the locking mechanism also includes tactile and audible signals indicating arrival of the locking mechansim at the unlocked position.

20 Claims, 12 Drawing Sheets

TABLET DISPENSER WITH LOCKING MEANS

BACKGROUND OF THE INVENTION

1. Field of the Invention

The present invention relates to dispensing containers, and more particularly, to such containers which dispense tablets.

2. Description of the Prior Art

Many containers incorporate a mechanism for dispensing their contents. Included among this group of containers are spray, pump and squeeze bottles, aerosol containers, and even some cigarette packs. In addition, several known dispensing containers are specifically directed to dispensing tablets. The term "tablets" as used herein includes pills, capsules, tablets, pellets and other relatively small objects, whether they be for medicinal or other purposes.

One example of a tablet dispensing container is disclosed in European Patent Application Number 345,413 which published on Dec. 13, 1989. This tablet dispensing container incorporates a housing and a reciprocating element. The reciprocating element extends through the housing. Upon pressing the reciprocating element at the top end, the bottom end of the reciprocating element which includes a tablet accommodating means passes through a dispensing opening in the housing with a tablet thereby dispensing the tablet.

Like many existing tablet dispensing containers, those described above have a tendency to permit tablets to be inadvertently dispensed. Also, the ease of dispensing that these containers offer creates another problem. Children of a particular age group are drawn to, and intrigued by the operation of such containers. More importantly, these same children have a tendency to place the dispensed contents into their mouths. This can be disastrous where medications or other potentially poisonous items are concerned. Thus, it is desirable to at least hinder a child's ability to obtain the container's contents, even if the container is not completely "child-proof". The additional time needed by the child to dispense the container's contents may be all that is needed to avoid a tragedy.

Several tablet dispensers include a "child-proof" mechanism. This "child-proof" mechanism prevents operation of the dispensing mechanism until it has been defeated. Each time a tablet is dispensed this extra mechanism must be defeated immediately prior to operating the dispensing mechanism. If the mechanism is not defeated prior to dispensing, then a pill cannot be dispensed from the container. As an example, U.S. Pat. No. 4,767,023 issued on Aug. 13, 1988 to Hackman et al. discloses such a "child-proof" mechanism. The mechanism is biased to prevent operation of the dispensing mechanism. Thus, each time a tablet is dispensed this mechanism must be operated to permit operation of the tablet dispensing mechanism.

One problem with the aforementioned tablet dispensers is that the "child-proof" mechanism must be operated each and every time a tablet is dispensed. In many instances this creates an unnecessary hurdle which must be overcome before a user can obtain a tablet. For example, inadvertent dispensing is most likely to occur under a particular set of circumstances. For example, it is highly unlikely that accidental dispensing will occur if the container is resting alone on a shelf. On the other hand, it is quite likely that accidental dispensing will occur if the container is stored in a purse.

Furthermore, some households have children of an age where accidental ingestion is a major concern while the vast majority of households do not have children in this age group. Almost all of us have had difficulty operating "child-proof" containers; often times when there is virtually no likelihood that a child could be endangered. Moreover, it may be desirable to dispense several tablets consecutively, and the mechanism unnecessarily hinders this operation. Consequently, it is desirable to have a dispensing container which includes a locking mechanism which could be either activated or left inactivated depending upon the desires and circumstances of the user.

Accordingly, it is an object of the present invention to provide a tablet dispenser with a locking mechanism which remains in either the locked or unlocked position until manually moved to the other position;

It is additionally an object of the present invention to provide such a tablet dispenser locking mechanism whose operation is self-evident to adults;

It is further an object of the present invention to provide such a tablet dispenser locking mechanism that is easily operated by adults, including the elderly;

It is also an object of the present invention to provide such a tablet dispenser locking mechanism that provides a tactile and/or audible indication when a particular status is reached;

It is additionally an object of the present invention to provide such a tablet dispenser locking mechanism that provides an indication which readily identifies its status as locked or unlocked;

It is lastly an object of the present invention to provide such a tablet dispensing container which accomplishes the aforementioned objectives at minimal costs.

SUMMARY OF THE INVENTION

In accordance with one aspect of the present invention a tablet dispensing container is provided. The tablet dispensing container comprehends a housing which includes a dispensing aperture and a reciprocating element aperture opposing each other. A reciprocating element which has a means for accommodating a tablet and an upper surface. The reciprocating element is attached to the housing and extends through the reciprocating element aperture. The reciprocating element is biased such that the means for accommodating a tablet blocks the dispensing aperture of the housing when at rest to form an enclosure. The tablet accommodating means is adapted to receive a tablet from inside the enclosure and, upon reciprocation of the reciprocating element, pass the tablet from inside the enclosure to the exterior of the enclosure through the dispensing aperture, thereby dispensing a tablet. A locking means for selectively preventing reciprocation of the reciprocating element is also included. The locking means can be selectively manually moved between a locked and an unlocked position. The locking means is adapted to remain in either the locked or the unlocked position until manually moved to the other position.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and wherein;

DESCRIPTION OF THE PREFERRED EMBODIMENTS

Figure 1:
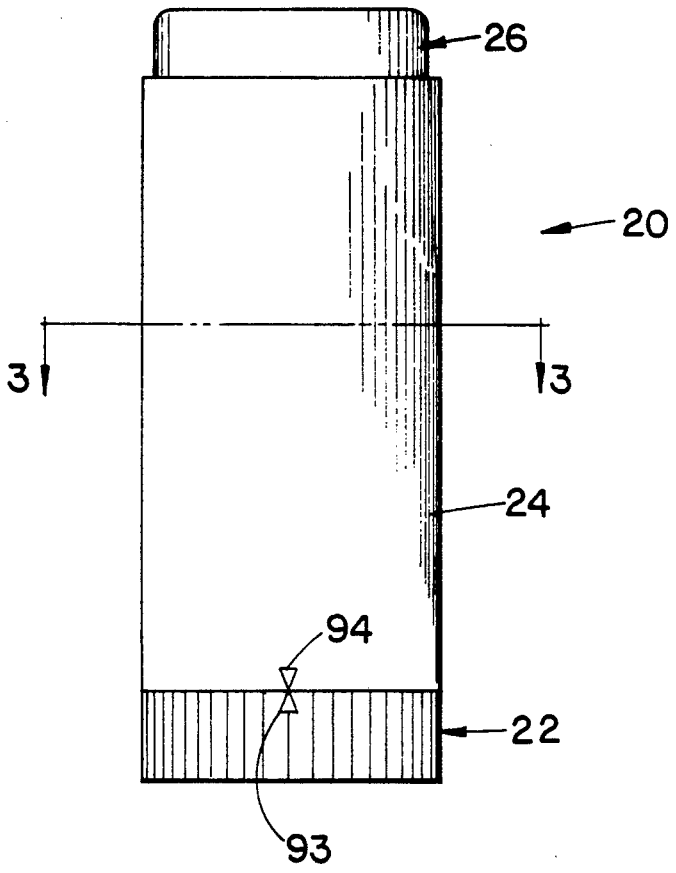
FIG. 1 is an elevation view of a first preferred embodiment of a tablet dispensing container of the present invention.

In a preferred embodiment seen in FIG. 1, a tablet dispensing container, indicated generally as 20, is provided. Importantly, this tablet dispensing container 20 incorporates a locking means 22 which is selectively manually moveable between locked and unlocked positions. The locking means 22 is adapted to remain in either the locked or the unlocked position until manually moved to the other position. This system provides a choice as to whether to lock the container 20 or not, thereby eliminating the need to defeat the locking means 22 each time a tablet is dispensed, if desired.

Figure 2:
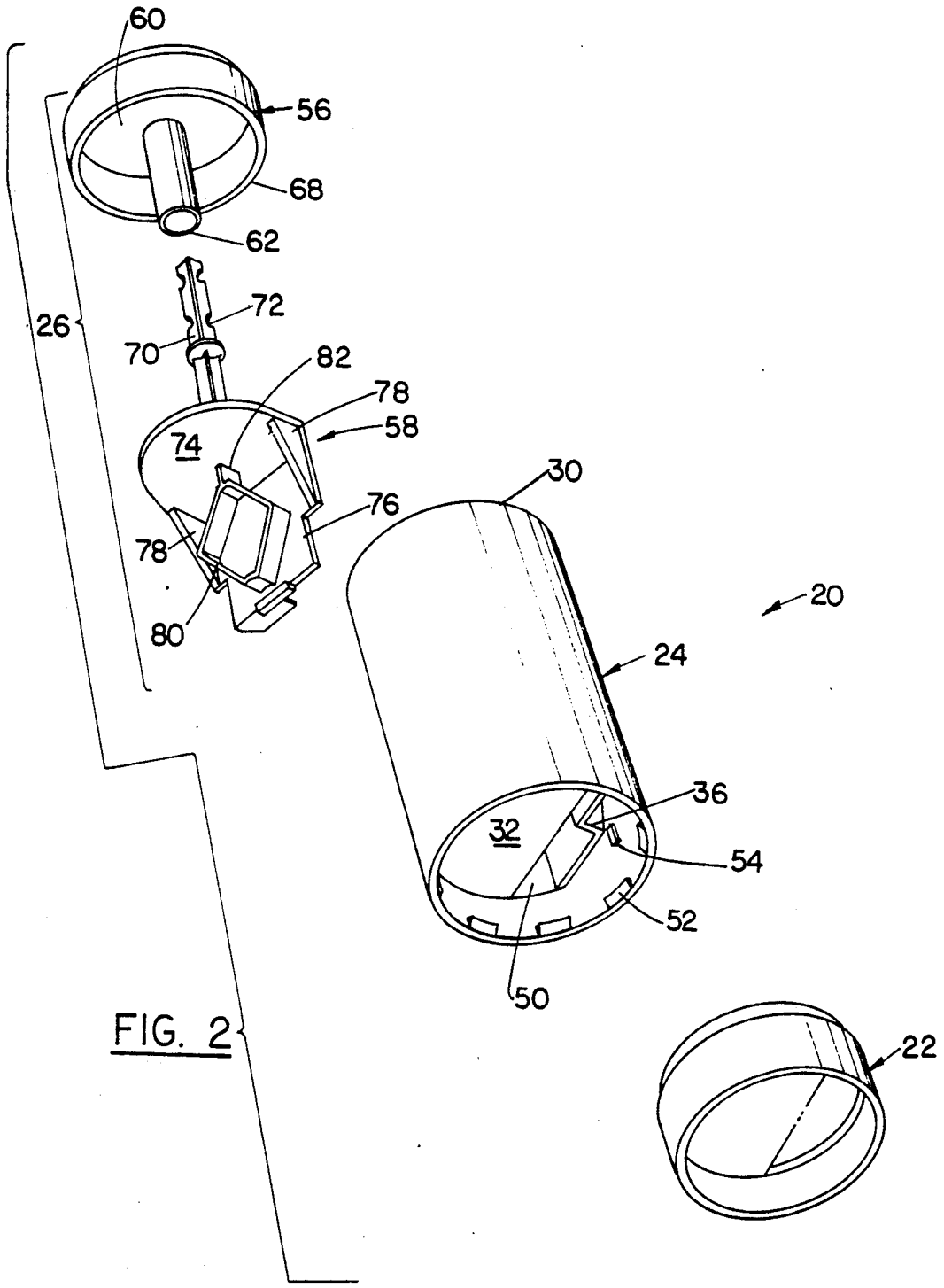
FIG. 2 is an exploded perspective view of the tablet dispensing container of FIG. 1 illustrating the various components thereof.
Figure 3:
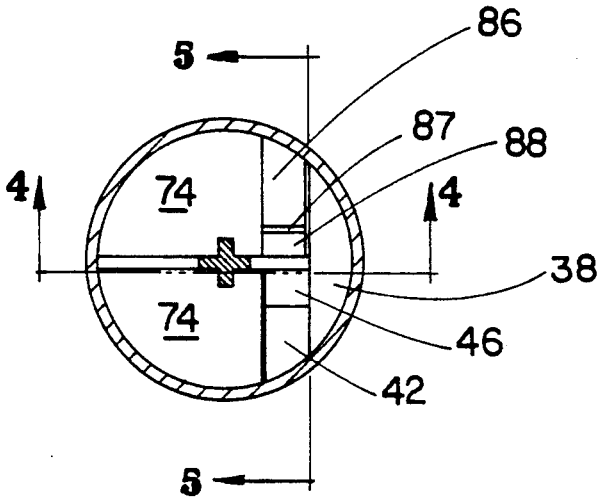
FIG. 3 is a cross-sectional top plan view of the tablet dispensing container of FIG. 1 taken along line 3—3 of FIG. 1.

Referring to FIG. 2, the tablet dispensing container 20 generally includes a housing 24; a reciprocating element 26 which incorporates a tablet accommodating means 88 (seen in FIG. 5); and the locking means 22. The housing 24 of this embodiment is a tubular sleeve having a substantially circular horizontal cross section. The housing 24 is open at the upper end creating a reciprocating element opening 30. Additionally, the housing 24 includes a generally horizontal bottom wall 32. This bottom wall 32 is attached near the lower end of the housing 24 leaving an opening having a segment shape.

Figure 4:
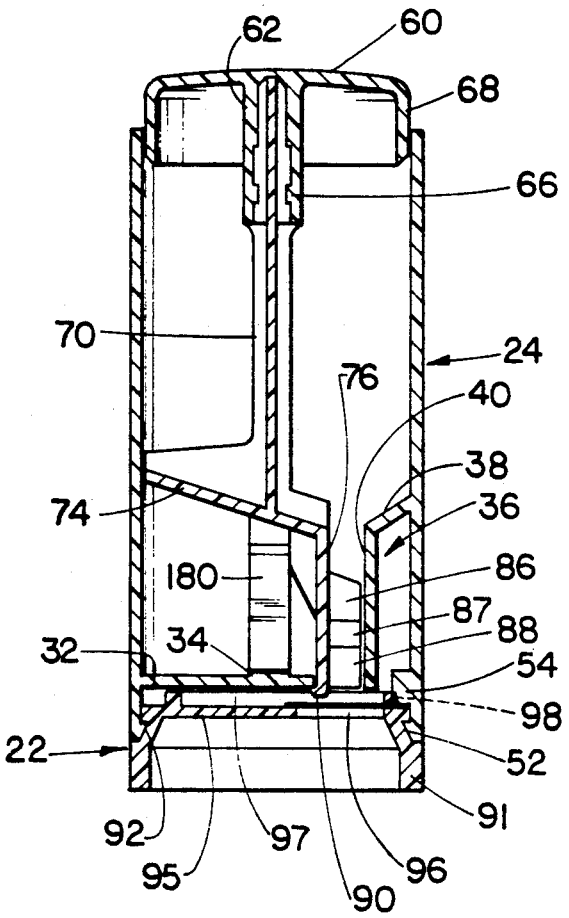
FIG. 4 is a cross-sectional elevation view of the tablet dispenser of FIG. 1 taken along line 4—4 of FIG. 3.
Figure 5:
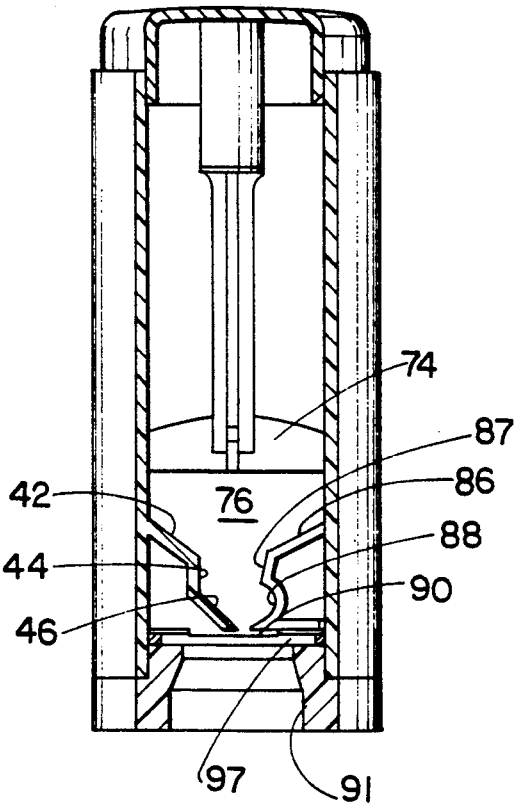
FIG. 5 is a cross-sectional elevation view taken along line 5—5 of FIG. 3.

Referring to FIGS. 4 and 5, the interior of the housing 24 has several notable features. The interior side of the bottom wall 32 includes a centrally located ridge 34. Also, a stationary interior wall 36 is preferably integrally molded with the housing 24. The interior wall 36 has several facets or surfaces 38, 40, 42, 44 and 46. Returning to FIG. 2, the interior wall 36 in combination with the bottom wall 32 creates a dispensing aperture 50 which communicates the interior of the housing 24 with the exterior. Additionally, eight lugs 52 are positioned upon the interior surface of the housing 24 below the bottom wall 32 equidistant from each other. Furthermore, a vertical ridge 54 is located above the lugs 52 and below the bottom wall 32 on the interior surface of the housing 24.

The reciprocating element 26 is preferably made of an upper part 56 and a lower part 58, although it could be integrally molded as one part. The upper part 56 includes the top wall 60 of the container 20 which is generally horizontal. An inner annular wall 62, having a relatively small diameter and large length, depends from the top wall 60. As seen in FIG. 4, a ridge 66 is located on the interior side of this inner annular wall 62. An outer annular wall 68 also depends from this top wall 60 and has an exterior diameter slightly less than the interior diameter of the housing 24. Thus, the outer annular wall 68 is able to slide into the housing 24 as the reciprocating element 26 is reciprocated. The top wall 60 in combination with the other annular wall 68 prevents escape of any tablets stored therein through the upper end of the housing 24.

In an alternative embodiment (not seen) the top wall 60 is attached to, and part of the housing 24. In this alternative embodiment the top wall 60 has an opening therein through which the reciprocating element 26 projects. In any case, the housing 24 in combination with the upper end of the reciprocating element 26 prevents the escape of any tablets stored therein through the upper end of the housing 24 while allowing manual access to the reciprocating element 26.

The lower part 58 is preferably integrally molded, yet includes many distinct element. A shaft section 70 extends axially and has a notch 72 at its upper end which cooperates with the annular ridge 66 of the inner annular wall 62 to attach the upper 56 and lower 58 parts together. The shaft section 70 is comprised of two planar elements centrally attached to each other at right angles. The lower end of the shaft is attached to a sloping wall 74. The lower end of the sloping wall joins a vertical wall 76. The vertical wall 76 is further attached to the sloping wall 74 by two stabilizing members 78. Attached to the underside of the sloping wall 74 is a biasing means 80. The biasing means 80 of this embodiment is a generally diamond shaped loop of plastic attached to the sloping wall 74 by a vertical member 82. At the lowest corner of the loop is a raised section 84 which cooperates with the ridge 34 on the bottom wall 32 to hold the biasing means 80 in place.

Referring to FIG. 4 and FIG. 5, attached to the other side of the vertical wall 76 are several facets or surfaces, 86, 87, and 88, extending perpendicularly therefrom. These surfaces 86, 87, 88 in conjunction with the vertical wall 76 provide a guide path, choke and tablet accommodating means 88 as will be discussed hereinafter. Additionally, a projection 90 extends horizontally from the lower end of the vertical wall 76 toward the biasing means 34. This projection 90 in combination with the bottom wall 32 serves to hold the housing 24 and reciprocating element 26 together.

In this embodiment the locking means 22 is a wheel 91 attached to the lower end of the tablet dispensing container 20. The wheel 91 has a groove 92 which cooperates with the lugs 52 of the housing 24 to attach the housing 24 and wheel 91 together. Below the groove 92, the wheel 91 has an outer surface which has substantially the same outer diameter as the housing 24. This outer surface is knurled to provide a non-slip tactile gripping surface. As seen in FIG. 1, this outer surface has a marking 93 which, when the wheel 91 is turned to the unlocked position, is aligned with a corresponding marking 94 on the outer surface of the housing 24. When the wheel 91 is turned to the locked position these markings, 93 and 94, do not line up. Thus, these markings, 93 and 94, provide an indication which readily identifies the status of the locking means 22 as locked or unlocked.

Figure 6:
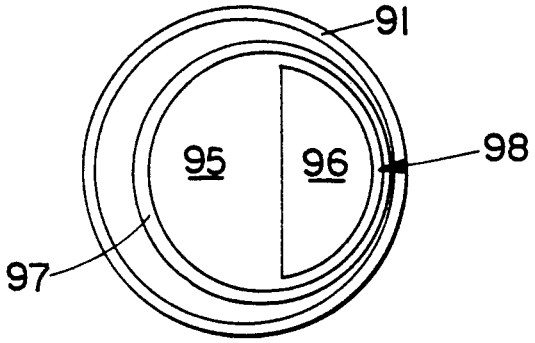
FIG. 6 is a top plan view of the wheel which forms the locking mechanism of the tablet dispensing container of FIG. 1.

Referring to FIG. 6 in conjunction with FIG. 4, the upper portion of the wheel 91 has a horizontal wall 95. This horizontal wall 95 is similar in shape to the bottom wall 32 of the housing 24 and includes a dispensing opening 96 having a segment shape. The reciprocating element 26 is able to pass through the dispensing opening 96 when properly aligned; i.e., when the wheel is turned to the unlocked position. When the wheel 91 is in the locked position the horizontal wall 95 prevents full reciprocation of the reciprocating element 26 thereby preventing a tablet from being dispensed.

Attached to the upper surface of the horizontal wall 95 is an annular ring 97. The annular ring 97 is unattached on the half nearest the dispensing opening 96 allowing this portion of the annular ring 97 to readily deform. The inner and outer boundaries of this annular ring 97 are defined by two circles having smaller and larger diameters respectively, the origins of which are offset from each other. The origin of the circle which defines the outer boundary is located slightly toward the dispensing opening 96 from the origin of the circle which defines the overall boundary of the horizontal wall 95. The origin of the circle which defines the inner boundary of the annular ring 97 is located a slight distance further toward the dispensing opening 96 than the origin of the circle which defines the outer boundary. A notch 98 is located in the annular ring 97 on a line which runs through the origins of the circles.

Returning to FIGS. 4 and 5, when assembled the outer boundary of the annular ring 97 adjacent the notch 98 abuts the interior surface of the housing 24; but exerts virtually no force thereon. However, as the wheel 91 rotates and the notch 98 approaches the ridge 54, the outer boundary of the annular ring 97 begins to push against and ride upon the ridge 54. The closer the notch 98 and ridge 54 become the greater the force upon the ridge 54 by the annular ring 97. Consequently, as the wheel 91 is turned to the unlocked position the wheel 91 becomes harder to turn. This provides a tactile indication that the wheel 91 is approaching the unlocked position. Likewise, as the wheel 91 is turned away from the unlocked position the wheel 91 becomes easier to turn.

When the dispensing opening 96 of the wheel 91 and the dispensing aperture 50 are aligned the notch 98 catches the vertical ridge 54 on the inner surface of the housing 24. Consequently, as the wheel 91 is moved into the unlocked position the annular ring 97 forces the notch 98 to snap against and "grab" the ridge 54 of the housing 24. This creates a tactile and audible indication that the locking wheel 91 is now in the unlocked position.

The approximate dimensions of the annular ring 97 of the preferred embodiment are provided herewith as exemplary of one possible annular ring 97. Other dimensions, and in fact other tactile and audible indication means, can readily be developed by those skilled in the art. The wheel 91 has an overall diameter of 42.4 mm. The horizontal wall 95 has an overall diameter of 40.2 mm. The diameter of the circle of the outer boundary of the annular wall 97 is 29.2 mm and the diameter of the inner boundary circle is 26.2 mm. The origin of the outer boundary circle is 5.5 mm away from the origin of circle defining the exterior boundaries of the horizontal wall. The origin of the inner boundary is 6.0 mm away from the origin of circle defining the exterior boundaries of the horizontal wall.

To operate the tablet dispenser 20 the locking means 22 is first turned to the unlocked position if it is not already in that position. If the markings, 93 and 94, on the wheel 91 and housing 24 line up then the locking means 22 is unlocked, otherwise the locking means 22 must be manually turned to the unlocked position. Opposing manual forces must be applied to the wheel 91 and the housing 24 to change the status of the locking means 22 because friction between these elements, 24 and 91, hinders their relative rotation; thereby requiring manual manipulation. As the locking means 22 is turned toward the unlocked position the wheel 91 becomes progressively harder to turn providing a tactile indication that the wheel 91 is approaching the unlocked position. Upon reaching the unlocked position the markings, 93 and 94, of the housing 24 and wheel 91 become aligned. Furthermore, a tactile and audible indication is provided by the annular ring 97 and ridge 54 that the wheel 91 has reachd the unlocked position. Due to the tactile and audible indications the locking means 22 can be operated in the dark and without the need for glasses. In addition, the markings, 93 and 94, provide a continual indication that the wheel 91 is in the unlocked position.

Once the locking wheel 91 is turned to the unlocked position tablets can be successively dispensed from the container 20 until the locking wheel 91 is manually turned to a locked position. To understand how tablets are dispensed from the container 20, refer to FIG. 7 through FIG. 10 of the drawings.

Figure 7:
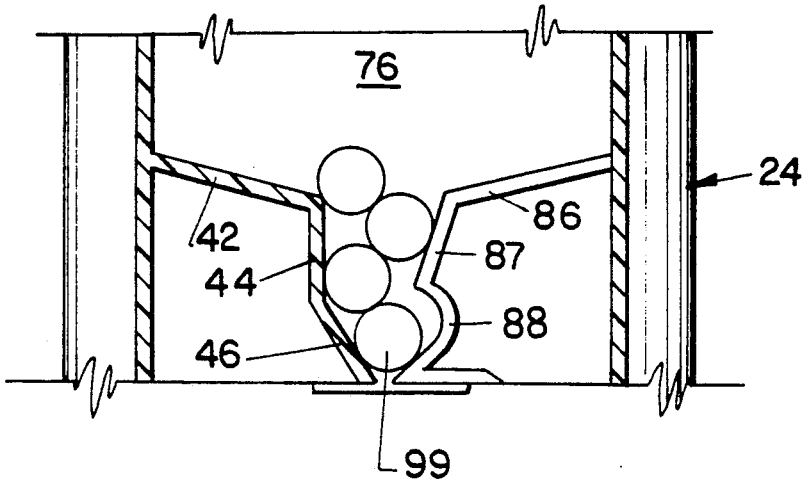
FIG. 7 is a fragmentary cross-sectional view similar to FIG. 5 illustrating the container of FIG. 1 at the start of the dispensing cycle.
Figure 8:
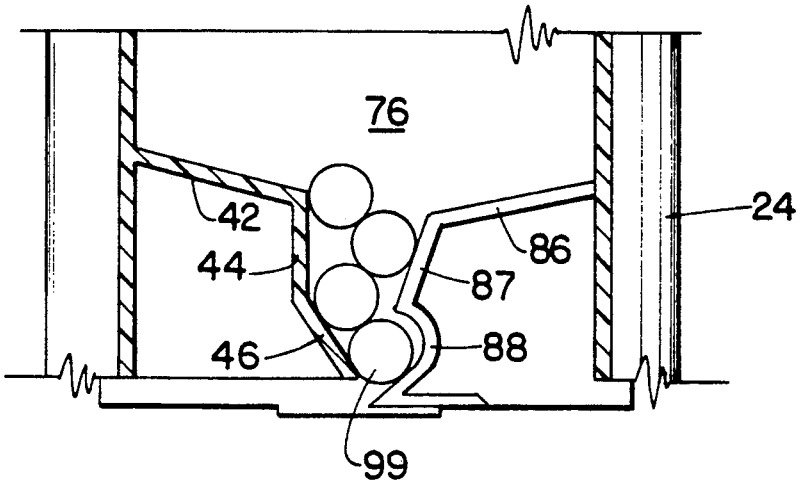
FIG. 8 is a fragmentary cross-sectional view similar to FIG. 7 illustrating the container between the start and midpoint of the dispensing cycle.
Figure 9:
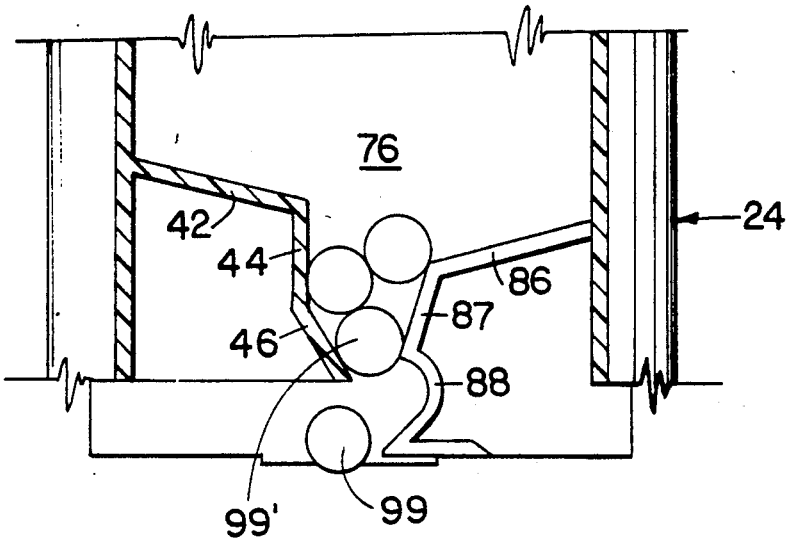
FIG. 9 is a fragmentary cross-sectional view similar to FIG. 7 illustrating the container between at the midpoint of the dispensing cycle.
Figure 10:
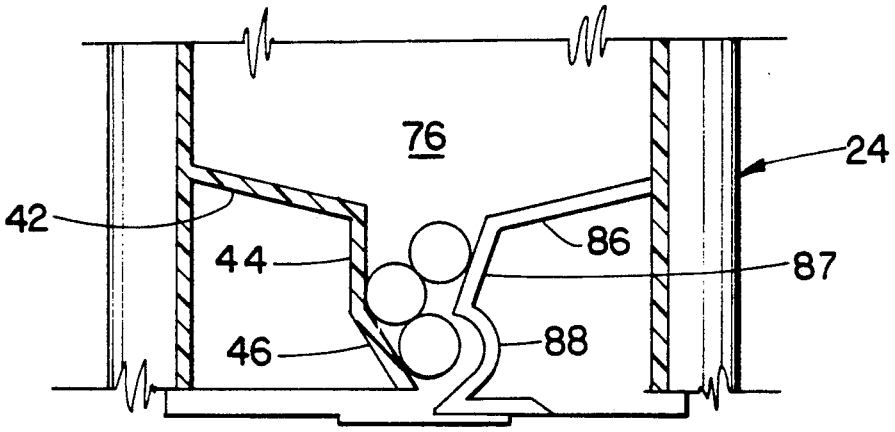
FIG. 10 is a fragmentary cross-sectional elevation view similar to FIG. 7 illustrating the container between the midpoint and end of the dispensing cycle.

The dispensing cycle begins with the reciprocating means 26 as seen in FIG. 7. The tablets are resting in the guide path created by the various surfaces 38, 40, 42, 44, 46, 76, 86, 87 and 88. FIG. 8 represents the container 20 shortly after the dispensing cycle begins. As the cycle begins the lowermost tablet 99 is directed into the tablet accommodating means of the reciprocating element by surface 46. Also, surface 87 nears surface 46 creating a choke point. Referring to FIG. 9, at the midpoint of the dispensing cycle the lowermost tablet 99 rolls out of the tablet accommodating means and is dispensed. The second tablet 99' is held within the dispenser 20 due to the choke point created between surface 46 and surface 87. As seen in FIG. 10, the cycle continues with the reciprocating element 26 returning to its original position. By the time the second tablet 99' is able to pass between the choke point between surface 46 and surface 87 it is held within the container by the tablet accommodating means and surface 46. The second tablet 99' becomes the lowermost tablet and will be dispensed in the next cycle. At the end of the cycle the container 20 is returned to its original status as seen in FIG. 7. After dispensing the desired number of tablets the locking means 22 can either be left in the unlocked position or turned to a locked position as desired.

A more complete explanation of the operation and structure of the container 20, minus the locking means 22, is provided in European Patent Application Number 345,413 which published on Dec. 13, 1989; the disclosure of which is hereby incorporated herein by reference. Although other tablet dispensing containers could include a locking means 22, the above-referenced tablet dispensing container is preferred. Therefore, the various embodiments shown in the drawings are all based upon this tablet dispensing container.

Figure 11:
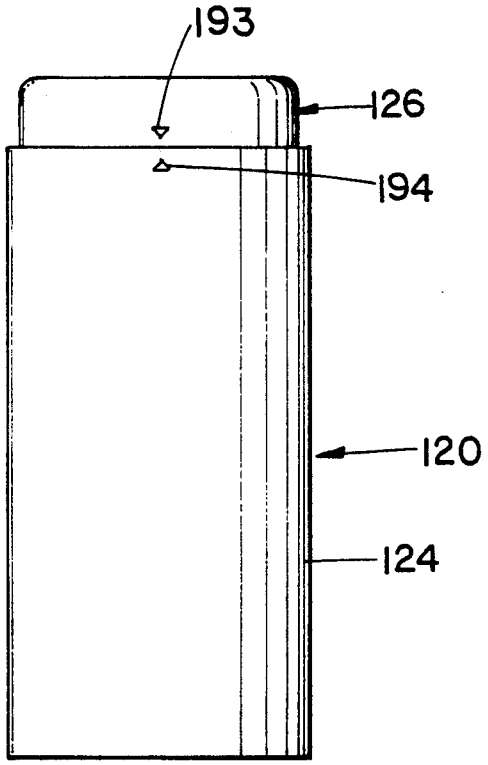
FIG. 11 is an elevation view of a second preferred embodiment of a tablet dispensing container of the present invention.
Figure 12:
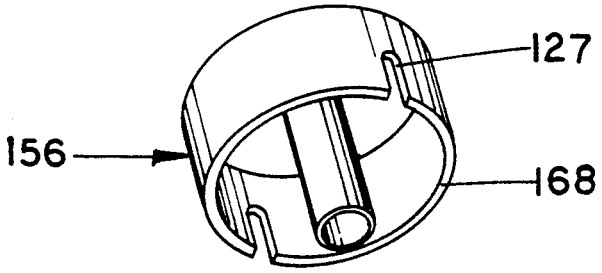
FIG. 12 is a perspective view of the upper part of the reciprocating element of the tablet dispensing container of FIG. 11.
Figure 13:
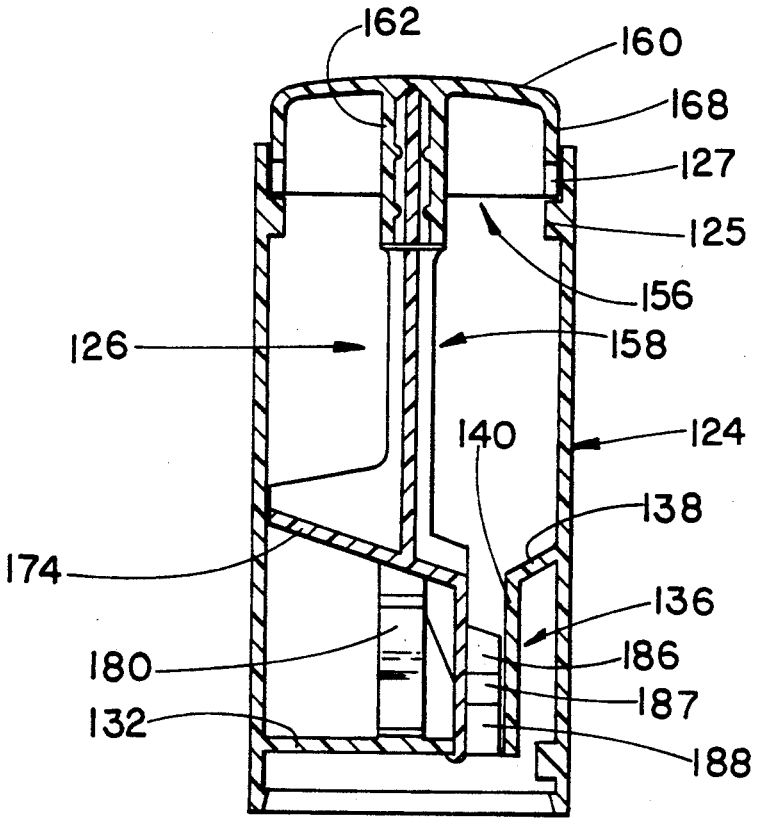
FIG. 13 is a cross-sectional elevation view similar to FIG. 4 of the tablet dispensing container of FIG. 11.

In a second preferred embodiment seen in FIG. 11, the tablet dispensing container 120 is generally similar in structure and operation to the embodiment of FIG. 1 except for the locking means 22. The locking means of this embodiment is associated with the upper end of the container 120. Referring to FIG. 13, the locking means of this embodiment includes two male parts 125 and two female parts 127. The female parts 127 of this embodiment are slots located in the outer annular wall 168 of the reciprocating element 126 and can best be seen in FIG. 12. The male parts 125 of this embodiment are projections located on the interior surface of the housing 24 near its upper end.

Like the previous embodiment, the reciprocating element 126 is made of an upper part 156 and a lower part 158. The upper and lower parts, 156 and 158, are joined such that the upper part 156 can be manually rotated without rotating the lower part 158. Friction at the joint between the upper part 156 and the lower part 158 prevents relative rotation between the parts unless opposing forces are manually applied to the parts, 156 and 158. As seen in FIG. 11, this embodiment has markings 193 and 194 similar to the first embodiment. The markings of FIG. 11 are located on the the reciprocating element 126 and the housing 124 which align when in the unlocked position.

To operate the dispenser the locking mechanism 122 must be in the unlocked position. The status of the locking mechanism 122 can be verified by checking to see if the markings, 193 and 194, are aligned. If so, the locking mechanism 122 is in the unlocked position. If not, then the locking mechanism 122 is in the locked position and must be manually turned to the unlocked position. The upper part 156 is rotated until the markings, 193 and 194, are aligned. At this point tablets can be dispensed as described previously.

Figure 15:
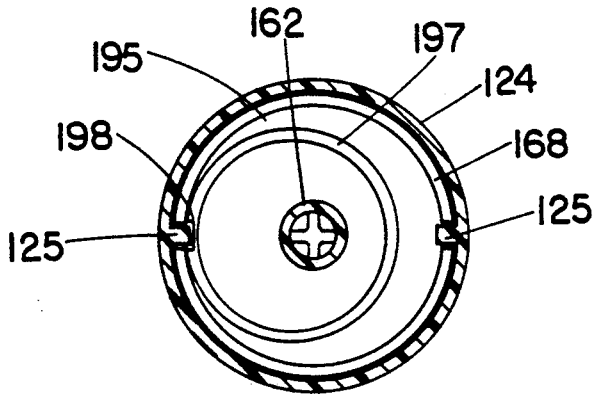
FIG. 15 is a schematic cross-sectional view of the tablet dispensing container of FIG. 14 taken along section line 15—15 of FIG. 14.
Figure 14:
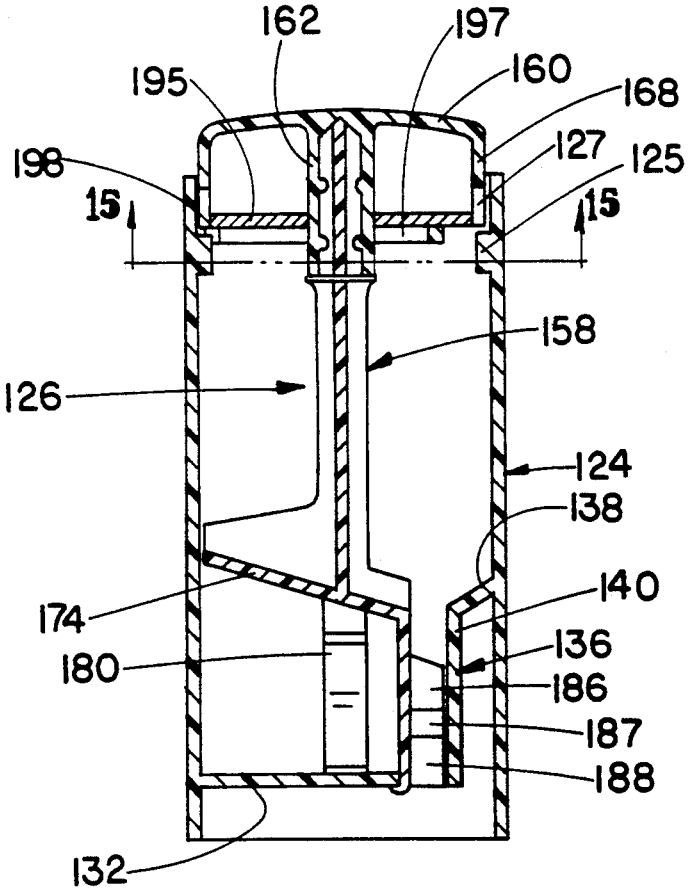
FIG. 14 is a schematic cross-sectional elevation view similar to FIG. 13 of the tablet dispensing container of FIG. 11.

A tactile indication is also provided by this configuration. If the reciprocating element 126 is pressed down while turning, then upon reaching the unlocked position the male parts 125 or projections will simply fall into the female parts 127 or slots thereby eliminating the need for lighting to operate the dispenser 120. A further modification of this embodiment, as seen in FIGS. 14 and 15, would includes attachment of an annular ring 197 to the bottom of the outer depending annular wall 168 which cooperates with a ridge 125 on the interior of the housing 124. An annular ring 197 similar to annular ring 97 is attached to the bottom surface of horizontal wall 195. A notch 198 similar to notch 98 is located in the annular ring 197. This provides the same audible and tactile indications as in the previous embodiment. Moreover, one skilled in the art could easily conceive of additional ways to provide a tactile and audible indication.

Although particular embodiments of the present invention have been shown and described, modification may be made to the package without departing from the teachings of the present invention. Accordingly, the present invention comprises all embodiments within the scope of the appended claims.

What we claim is:

1. A tablet dispensing container comprising:

(a) a housing having a dispensing aperture and a reciprocating element aperture opposing each other therein, the dispensing aperture being located at the lower end of said housing and the reciprocating element aperture being located at the upper end of said housing;

(b) a reciprocating element having an upper end associated with the upper end of said housing and a lower end associated with the lower end of said housing and a means for accommodating a tablet and an upper surface, the reciprocating element being attached to the housing and extending through the reciprocating element aperture and being biased such that the means for accommodating a tablet blocks the dispensing aperture of the housing when at rest forming an enclosure, the tablet accommodating means being adapted to receive a tablet from inside the enclosure and, upon reciprocation of the reciprocating element, pass the tablet from inside the enclosure to the exterior of the enclosure through the dispensing aperture, thereby dispensing a tablet; and (c) a locking means for selectively preventing reciprocation of the reciprocating element; the locking means being selectively manually moveable between a locked position and an unlocked position, the locking means being adapted to remain in the locked position until manually moved to the unlocked position and the locking means being adapted to remain in the unlocked position until manually moved to the locked position.

2. A tablet dispensing container according to claim 1 wherein the locking means is associated with the lower end of the reciprocating element.

3. A tablet dispensing container according to claim 2 wherein the locking means is a locking wheel which has a dispensing opening therein attached to the lower end of the tubular sleeve, in the locked position the wheel limits movement of the reciprocating element preventing tablet dispensing and in the unlocked position the wheel permitting movement of the reciprocating element through the dispensing opening and permitting tablet dispensing.

4. A tablet dispensing container according to claim 3 wherein the locking means includes a tactile signal and an audible signal indicating arrival of the locking means at the unlocked position.

5. A tablet dispensing container according to claim 4 wherein the tactile signal and the audible signal are provided by an offset annular ring attached to the locking means and having a notch therein which is forced against a ridge attached to the interior of the housing creating the signals.

6. A tablet dispensing container according to claim 4 wherein the locking means includes a visual signal indicating when the locking means is in the unlocked position.

7. A tablet dispensing container according to claim 2 wherein the locking means includes a tactile signal and an audible signal indicating arrival of the locking means at the unlocked position.

8. A tablet dispensing container according to claim 7 wherein the tactile signal and the audible signal are provided by an offset annular ring attached to the locking means and having a notch therein which is forced against a ridge attached to the interior of the housing creating the signals.

9. A tablet dispensing container according to claim 1 wherein the locking means is associated with upper end of the reciprocating element.

10. A tablet dispensing container according to claim 9 wherein reciprocating element further comprises an outer annular wall depending from the upper surface, and wherein the locking means includes a female part located on one of either the outer depending wall of the reciprocating element or the upper end of the housing, and a cooperating male part extending from the other of the outer depending wall of the reciprocating element or the upper end of the housing, the male and the female parts being aligned in the unlocked position permitting reciprocation of the reciprocating element and being offset in the locked position preventing reciprocation of the reciprocating element.

11. A tablet dispensing container according to claim 10 wherein the female part is located on the outer depending wall of the reciprocating element and the male part is located on the housing.

12. A tablet dispensing container according to claim 11 wherein the tactile signal and the audible signal are provided by an offset annular ring attached to the locking means and having a notch therein which is forced against a ridge attached to the interior of the housing creating the signals.

13. A tablet dispensing container according to claim 11 wherein the locking means includes a visual signal indicating when the locking means is in the unlocked position.

14. A tablet dispensing container according to claim 13 wherein the tactile signal and the audible signal are provided by an offset annular ring attached to the locking means and having a notch therein which is forced against a ridge attached to the interior of the housing creating the signals.

15. A tablet dispensing container according to claim 13 wherein the locking means includes a visual signal indicating when the locking means is in the unlocked position.

16. A tablet dispensing container according to claim 10 wherein the locking means includes a tactile signal and an audible signal indicating arrival of the locking means at the unlocked position.

17. A tablet dispensing container according to claim 9 wherein the locking means includes at tactile signal and an audible signal indicating arrival of the locking means at the unlocked position.

18. A tablet dispensing container according to claim 17 wherein the locking means includes a visual signal indicating when the locking means is in the unlocked position.

19. A tablet dispensing container according to claim 1 wherein the locking means includes a tactile signal and an audible signal indicating arrival of the locking means at the unlocked position.

20. A tablet dispensing container according to claim 19 wherein the tactile signal and the audible signal are provided by an offset annular ring attached to the locking means and having a notch therein which is forced against a ridge attached to the interior of the housing creating the signals.

* * * * *